US005271250A

United States Patent [19]

Benito

[11] Patent Number: 5,271,250

[45] Date of Patent: Dec. 21, 1993

[54] AUTOMATIC FLAT-BED KNITTING MACHINE HAVING A DEVICE FOR EFFECTING VERTICAL TENSION IN THE FABRIC PRODUCED THEREBY

[75] Inventor: Stoppazzini Benito, Sala Bolognese, Italy

[73] Assignee: EMM S.R.L., Bologna, Italy

[21] Appl. No.: 914,259

[22] Filed: Jul. 15, 1992

[30] Foreign Application Priority Data

Jul. 18, 1991 [IT] Italy ..... BO92 A 000265
May 25, 1992 [IT] Italy ..... B092A 000208

[51] Int. Cl.[5] ..... D04B 15/88
[52] U.S. Cl. ..... 66/152
[58] Field of Search ..... 66/147, 148, 149 R, 66/150, 151, 152, 153, 149 S; 139/291, 305; 226/120, 123, 128

[56] References Cited

U.S. PATENT DOCUMENTS 629,892 8/1899 Donner ..... 66/150
2,610,495 9/1952 Diem ..... 66/152
4,503,690 3/1985 Goller et al. ..... 66/149 R
4,646,544 3/1987 Merkh ..... 66/149 R
4,660,392 4/1987 Stoppazzini ..... 66/152 X

FOREIGN PATENT DOCUMENTS 0185851 9/1985 Japan ..... 66/152
69470 10/1914 Switzerland ..... 66/149

*Primary Examiner*—Clifford D. Crowder
*Assistant Examiner*—Larry D. Worrell, Jr.
*Attorney, Agent, or Firm*—McAulay Fisher Nissen Goldberg & Kiel

[57] ABSTRACT

In a device associated with two longitudinal needle beds below which the fabric being formed exists, a series of fabric holding parts are arranged below the needle beds appropriately spaced out, and carried by vertically sliding guided supporting parts, while slide parts, fixed to the supporting parts slide vertically operated with an alternate motion, between a raised position, where the fabric is held, and a lowered position where the fabric is released. Between these holding parts there are gripper parts, spaced out uniformly in a longitudinal direction, which when activated hold the fabric when this fabric is released by the holding parts.

12 Claims, 7 Drawing Sheets

71
72
K
69a
69
67
S
A
66
67a
68
62a
63
62
H
65
S2
R
60
7
8
51
53
50
I
67b
VII
52
9
54
70
66a
64
S1

AUTOMATIC FLAT-BED KNITTING MACHINE HAVING A DEVICE FOR EFFECTING VERTICAL TENSION IN THE FABRIC PRODUCED THEREBY

BACKGROUND OF THE INVENTION

1. Field of the Invention

This invention relates to the technical field concerning the production of automatic machines, for example flat-bed or circular knitting machines.

2. Description of the Prior Art

It is known that flat-bed knitting machines generally envisage two needle beds along which a carriage travels longitudinally with alternate motion.

The carriage contains appropriate actuator units for the needles that are fitted inside transverse slits at regular distances along the needle beds.

These actuator units actuate the needles in succession, according to the commands provided by an electronic control unit programmed with a suitable fabric knitting program, so as to achieve the formation of a series of so-called fabric rows.

The machines mentioned require the vertical stretching of the fabric. Various devices are currently used for this purpose, including generally one or more rollers placed below the needles beds and parallel thereto. The roller(s) designed to catch and pull the fabric being formed.

A device of this nature includes, for example, a pair of counter-rotating rollers which are knurled and which are made to touch each other for a preset time interval at the end of each carriage stroke.

Another known device involves a single rotating roller that stretches along the entire length of a needle bed below which it is fitted and which is equipped with a multitude of pins that penetrate between the fabric stitches.

These devices generally produce an uneven stretching in the various machine working areas, giving unsatisfactory results in the knitted fabric. These is in fact a progressive slackening in the fabric, with the passage of each operating unit.

Many of the known devices are extremely complex and this complexity has a negative effect on their performance as well as on their maintenance and production costs.

U.S. Pat. No. 4,854,134, issued to the present applicant, describes a device aimed at making and maintaining the vertical stretching of fabric homogeneous, acting on adjacent sectors of the same fabric.

This device includes a series of coaxial drums with the revolving support of rotating axes and connected to these axes by appropriate elastic parts, each of these drums having a tangential contact with at least two rollers driven by second spring means; the fabric lies between these drums and the relative presser rollers.

Appropriate actuator parts are designed to drive one of the rollers with a rotation of a preset amplitude, to determine the rotation of the relative drum, in phase with the formation of a corresponding portion of the last row of fabric.

Another problem that exits in the traditional stretching devices is the different tension that is often found in different areas of fabric, as shown for example in FIG. 10. The known devices are only able to pull the central part of the fabric, while the areas that extend on either side of this central part are not stretched.

SUMMARY OF THE INVENTION

The aim of this invention is that of producing a device that makes it possible to obtain the uniform stretching of all adjacent portions of fabric, even in the presence of areas of different lengths regardless of the type of fabric of the type of knit of the same.

Another aim of this invention is that of proposing a device for the vertical stretching of fabric obtained with a simple, functional and reliable technical solution, which is also versatile to use.

The above mentioned aims are achieved by means of a device installed on an automatic knitting machine, in particular a flat-bed knitting machine including two longitudinal needle beds supported by a fixed frame and below which a fabric being formed exits for the vertical stretching of said fabric.

This device includes a series of holding parts for said fabric, said holding parts being arranged below said needle beds and regularly spaced out. Each holding part includes a first jaw, hinged to an oscillating corner piece slidingly fixed to a first support part fastened to a needle bed, and a second oscillating jaw hinged to a second support part slidingly fixed to the other needle bed, so that the two supports are arranged facing each other:

a plurality of slides connected to the support parts and activated to slide vertically with an alternating motion, between a raised position where said fabric is held and a lowered position where the fabric is released;

a plurality of cams designed to provide angular rotation in opposite directions of the corner piece and oscillating jaws to close the holding parts, in suitable phase with the formation of the rows of said fabric, while in said raised position of the slides.

BRIEF DESCRIPTION OF THE DRAWINGS

The characteristics of the invention are described below, with particular reference to the attached drawings, in which.

DESCRIPTION OF THE PREFERRED EMBODIMENT

Figure 1:
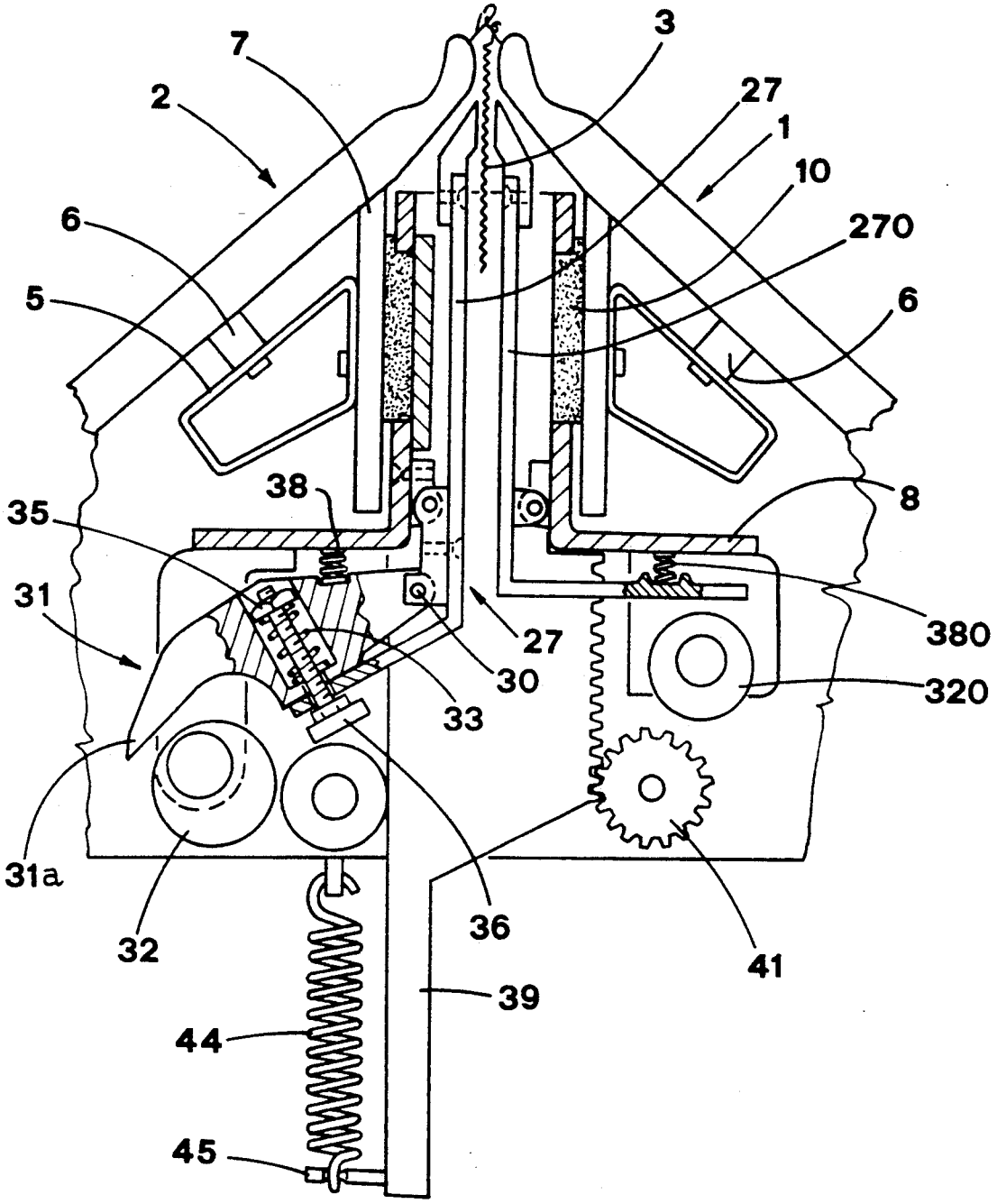
FIG. 1 illustrates a cross-sectional view of the stretching device of this invention.

With reference to the above figures, an automatic flat bed knitting machine has two needle beds 1 and 2, and has a portion 3 of a knitted fabric in formation. The needle beds 1 and 2 are equipped, in the known manner, with uniformly spaced out transverse slits in which the needles 4 are inserted, actuated by their respective operating systems.

The needle beds 1 and 2 are supported by a fixed frame forming a pair of platforms 5 below needle beds 1, 2; the platforms 5 are fixed to the lower surfaces of the needle beds 1, 2 by means of a series of spacer parts 6. The platforms 5 are fixed to their respective cross-members 7 that define two opposite vertical surfaces that extend lengthwise along the needle beds 1, 2.

Two angular elements 8,9 are vertically slidable with respect to cross-members 7. The angular elements 8, 9 are joined together, at their tips, by means of a known type of structure, not shown in the drawings.

The angular elements 8, 9 and the cross-members 7 are separated by appropriate pads 10 of anti-friction material, designed to reduce the sliding friction. The pads 10 have on one face a narrowed part 10*a*, that is inserted in a corresponding opening 11 in the angular elements 8, 9, and blocked by a plate 12 placed longitudinal to the angular pieces; this plate 12 is secured by means of screws 13 that pass through holes 14 and 15 of the angular elements 8, 9 and the same plate 12 and screw into the corresponding holes 16 on the pads 10 (see FIG. 4).

A corner piece 270 is hinged to the vertical part of the first angular element 8, by means of a pin 290, fitted to this element adjacent to its lower border. The corner piece 270 is normally arranged with the same orientation as element 8.

The horizontal side of the corner piece 270 is subject to the action of spring means 380, lying between this same side and the side of the first angular element above 8, as well as the action of a first cam shaft 320, that pushes against these spring means; this shaft has its rotating support on the end of the structures supporting the angular elements 8, 9, and is arranged so as to be parallel to the machine.

A series of first jaws 17 are regularly spaced from one another. These jaws 17 oscillate in synchrony as a consequence of the oscillation of the corner piece, and are designed to act in conjunction with a corresponding second series of oscillator jaws 18, so as to form parts 19 for holding the fabric 3 to be stretched.

Figure 4:
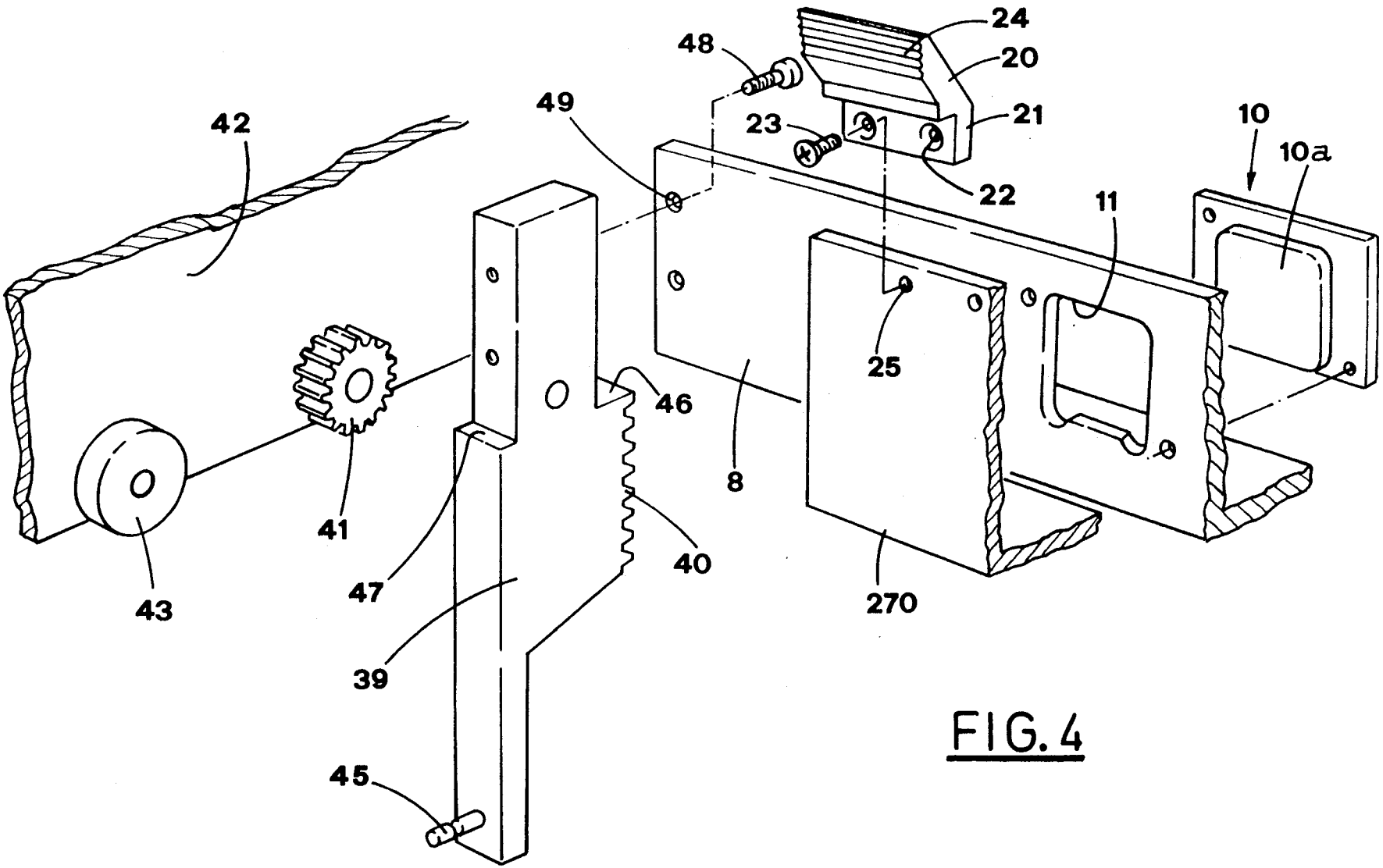
FIGS. 4 and 5 illustrate, in respective exploded drawings, the holding-jaw activating parts of this device.

The first and the second jaws 17 and 18 are very similar to each other and comprise a ledge 20 protruding from a body 21. Body 21 has a pair of holes 22 to fit the relative securing screws 23. The ledge 20 slopes upwards and features a holding vertical surface 24 that is knurled (FIG. 4).

The first jaws 17 are screwed to holes 25 in the corner piece 270. The second jaws 18 are screwed into holes 26 of the respective combs 27 that are connected, by relative hinged parts 28, to the second angular element 9.

Figure 5:
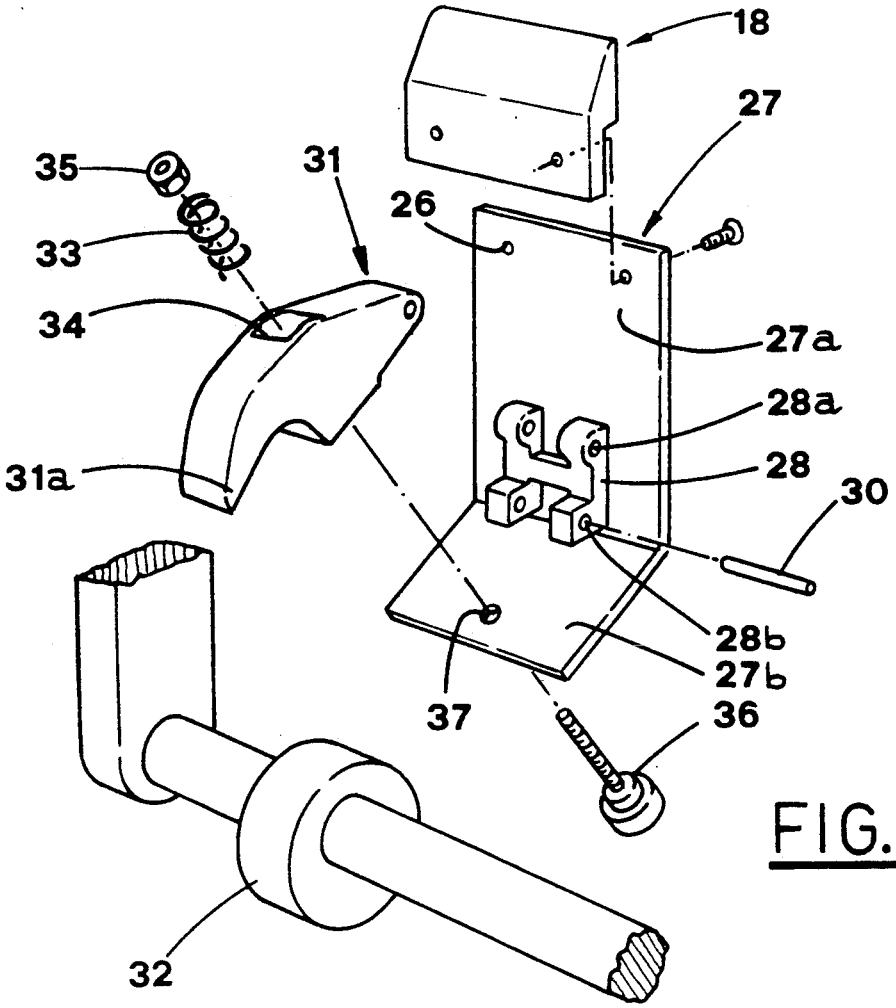

Combs 27 have an upper portion 27*a*, which is designed to face the cross-member 7 and bearing at its tip the respective second jaw 18, and a lower portion 27*b* facing downwards; the downward facing portion 27*b*, when assembled, is below the angular element 9 (see FIG. 5).

The hinge 28 designed to received 28*a*, 28*b* designed to receive pins 29 and 30, respectively, for hinging the angular element 9 and a lever 30 respectively thereto. The pins 29, 30 are parallel to the machine, pin 29 being positioned at the same height as pin 290. The level 31 features a beak-like tail 31*a* that overhangs a second cam shaft 32 that is rotatably supported at both ends by the structure that holds the angular elements 8, 9 so that it lies horizontal axes longitudinal to the machine.

The first and second cam shafts 320, 32 are similar in shape, and operate in synchrony so that the corresponding jaws 17, 18 oscillate while rotating in opposite directions.

The lever 31 normally rests against the downward facing part 27*b* of the comb 37 and is held in position by the action of a spring 33 fitted in a housing 34 made in the same lever 31. The spring 33 is retained, with a counter nut 35, by a knob 36 inserted through a hole 37 of the downward facing portion 27*b* of the comb 27; the head of this knob 36 rests against the lower surface of the downward facing portion 27 *b*.

The upper surface of the lever 31 and the angular element 9 are subjected to the action of another spring 38.

Between the angular elements 8, 9 in correspondence with the ends of the needle beds 1, 2 there are a pair of symmetrical slides 39, only one of which can be seen in the drawings. Each slide 39 has a rack profile 40 on one side that engages with a pinion 41 rotatably supported by the fixed frame 42 of the machine and designed to be intermittently operated by appropriate drive parts.

On the side opposite the rack 40, the slide 39 is guided by a counter roller 43, also revolving on a support attached to the frame 42. The action of the rack 40 is also balanced by a spring 44 suspended vertically on the frame 42 and hooked to a pin protruding from the lower end of the slide 39.

The slide 39 features at both sides opposite shoulders 46, 47 designed to define a resting surface for the angular elements 8 and 9 respectively. The slide 39 is also connected to angular elements 8, 9 by means of screws 48 that pass through the corresponding holes 49 in the same angular elements.

The device also envisages a series of gripper parts 50 (FIG. 6) designed to hold the fabric 3 firmly. These gripper parts 50 consist of a pair of spring arms 51, 52 made mobile, in synchrony between an inoperative position I (FIGS. 6, 8) and an operative position 0 (FIG. 9).

Figures 6, 6A, 7:
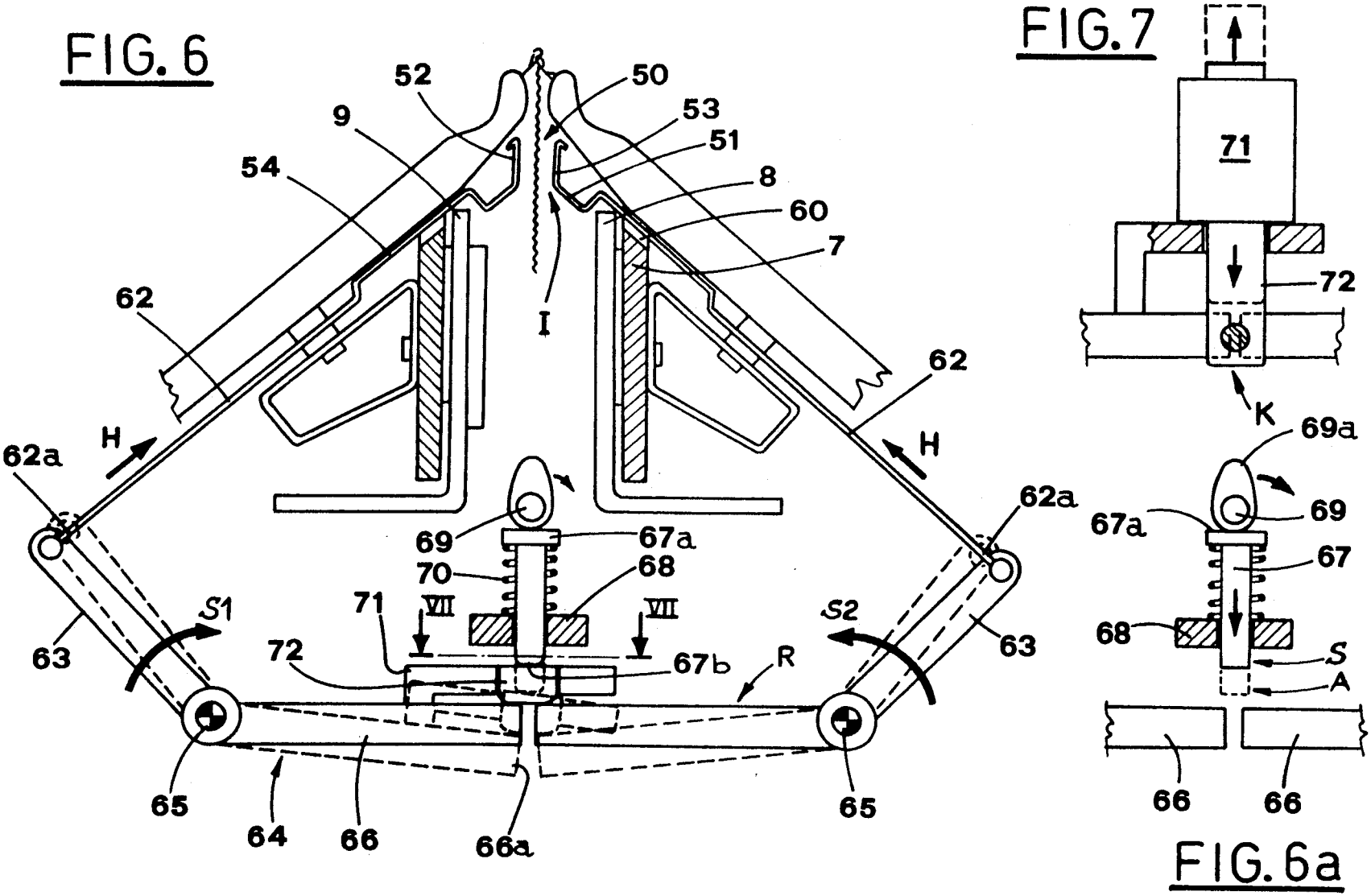
FIG. 6 illustrates a cross-sectional view of the device along a different plane to the cross-sectional view of FIG. 1 that shows the gripper parts of the same device.
FIG. 6*a* illustrates item 200 of FIG. 6 in its inoperative configuration.
FIG. 7 illustrates, the view of the section VII—VII in FIG. 6.

The grippers 50 are arranged at equal distances along the cross-members 7 and in intermediate positions with respect to the jaws 17, 18. Arms 51, 52 are guided against the lower surface of the needle beds 1, 2 (FIG. 6). The arms 51, 52 of the grippers 50 also consist of a shaped element forming, at one end, a front head 53 that vertically faces the fabric 3 being formed, and in the middle a curved part 54, with the concave part facing upwards. The curved part runs in a corresponding slot 60 made in the summit of the relative cross-member 7, and is connected, as a single piece, to an end rod 62.

The lower ends 62*a* of the rods relative to the arms 52, 53 of the same gripper 50 are joined to the upper ends of relative first arms 63 of the corresponding levers 64 which are hinged to the shafts 65, which are, in turn, attached to the machine frame with horizontal axes arranged longitudinal to the machine. The second arms 66 of the levers 64 are almost horizontal with the free heads 66*a* facing one another.

Above each pair of these latter heads a relative vertical shank 67 is fixed, sliding through a fixed guide part 68, fitted at the top with a plate 67*a*.

Between the plate 67*a* and the guide part 68 there is a spring 70, within which the shank 67 is inserted. Spring 70 maintains plate 67*a* in contact with a cam 69*a* supported by a cam shaft 69. Cam shaft 69 revolves on a support attached to the machine frame and is pulled into rotation in synchrony with the cam shafts 32, 320.

The action of the cam 69*a*, biased by the spring 70, gives the shank 67 two extreme positions respectively raised S and lowered A (FIG. 6*a*).

The shank 67 in the lowered position A does not intercept the opposing heads 66*a* (FIG. 6*a*).

One of the second arms 66 is fixed to an electromagnet 71 fitted with a relative mobile anchor 72; when the electromagnet is energized, this mobile anchor adopts an extreme position K (FIG. 7) in which the same anchor lies between the lower end 67*b* of the shank 67 and the relative opposing heads 66*a*.

In this latter case the lower end 67*b* of the shank 67, during the descent of the latter, intercepts the heads 66*a* with oscillation of the levers 64 in the opposite directions S1, S2, with transfer of the rods 62 upwards (H direction), and consequently defines the operative position O for the arms 51, 52 of the gripper 50 (FIG. 9).

Spring means (not illustrated) hold the levers 64, when the shank 67 is in the raised position S, in the relative rest position R (indicated with the continuous line in FIG. 6) which corresponds to the inoperative position I (FIG. 8) for the arms 51, 52 of the gripper 50.

It should be noted that the eventual operative position O is commanded by the holding parts 19 in their lowered position and before they open, with this position maintained during the lifting of the same holding parts and until these latter parts close as explained below.

In short, with the electromagnet 71 energized, the gripper 50 assumes the operative O and inoperative I position intermittently commanded as a consequence of the rotation of the cam shaft 69, while with the electromagnet 71 de-energized, the gripper 50 remains in the inoperative position I.

The functioning of the device described is now illustrated starting with the stage in which the holding parts 19, formed by the jaws 17, 18, are opened in a raised position (FIG. 1). In this position the aforementioned holding parts 19 are in their topmost position, very close the area where the so-called rows of fabric 3 are formed, in correspondence with the needle beds 1, 2.

While rotating, the cam shafts 32 and 320 act on the beaks 31*a* of the levers 31 and on the angular piece 270, making the combs 27 and the angular piece 270 swing in synchrony with the formation of the rows of knitting. The Jaws 18, 17, supported by the combs 27 and the angular piece 270, are thus made to join each other, blocking the fabric 3.

Figure 2:
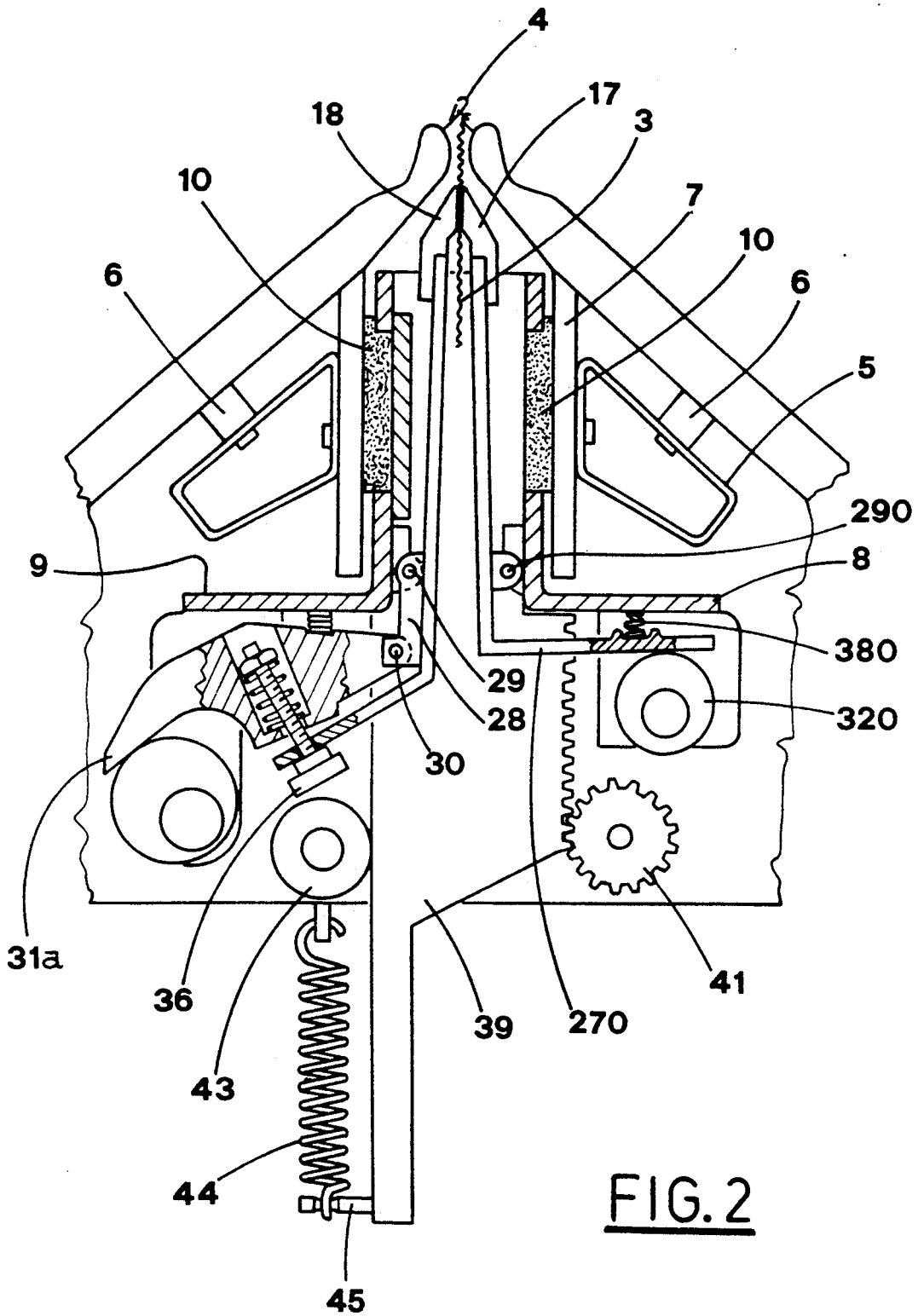
FIGS. 2 and 3 illustrate corresponding cross-sectional views of the inventive device, respectively in the fabric holding and in the stretching position.

Further rotation of the cam shaft 32 determines subsequently the angular rotation of the levers 31 with respect to the relative combs 27, loading the springs 33, as well as the springs 38 (FIG. 2). In this manner an ideal fabric 3 holding tension is obtained, as a function of the action of the springs 33; this holding tension can be appropriately adjusted by means of the knobs 36 holding the same springs 33.

Figure 3:
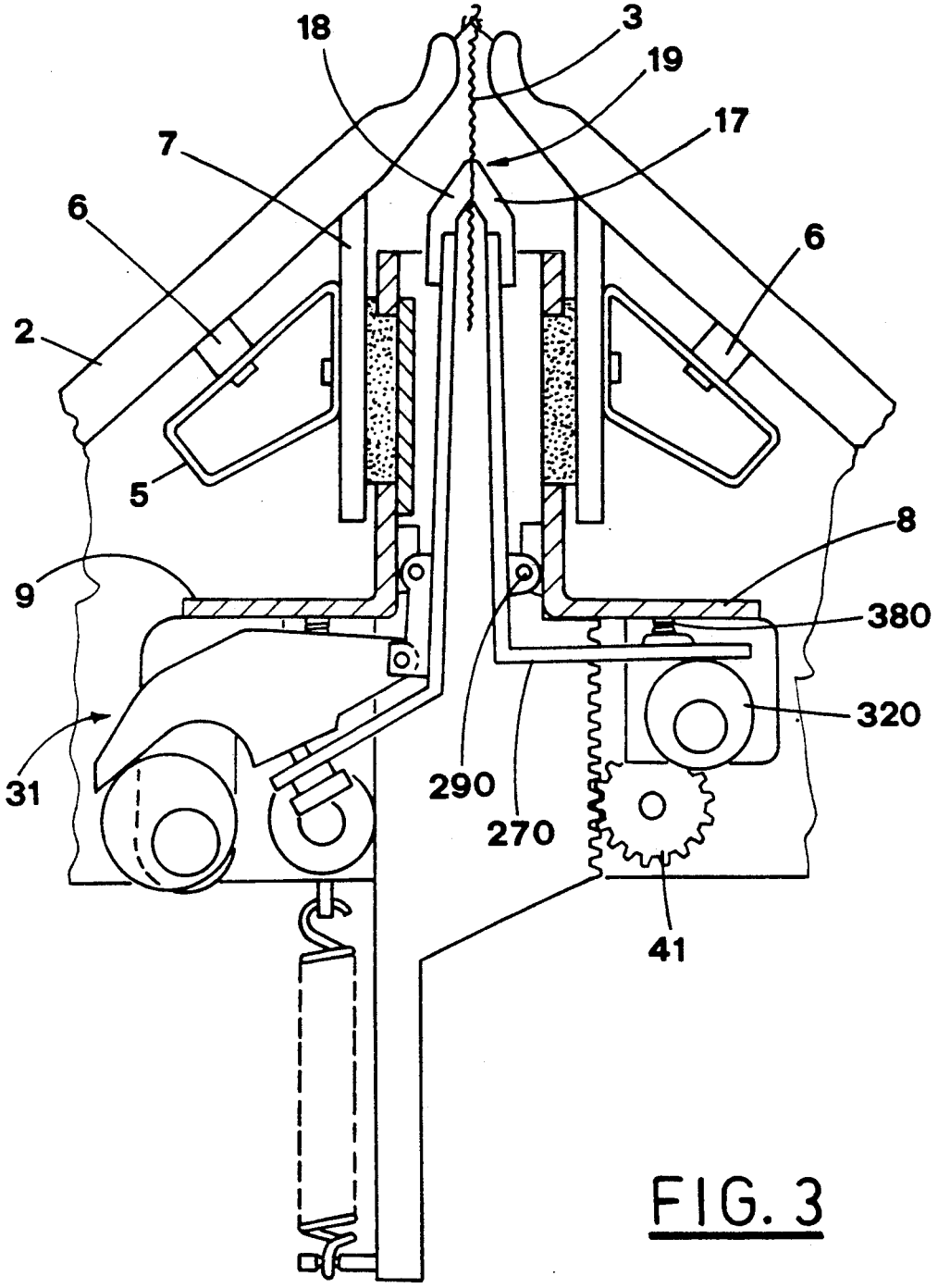

Once fabric 3 is firmly held, the command is given for downward sliding of the slides 39 connected to the angular elements 8, 9 that act as supporting parts for the jaws 17, 18, so as to achieve the stretching of the same fabric (FIG. 3). This sliding is obtained by the intermittent rotation of the pinions 41 that are engaged in the racks 40 of the slides 39. The intermittent rotation of the pinions 41 and therefore the lowering of the slides 39 is appropriately determined in relation to the characteristics of the fabric being made.

Figure 8:
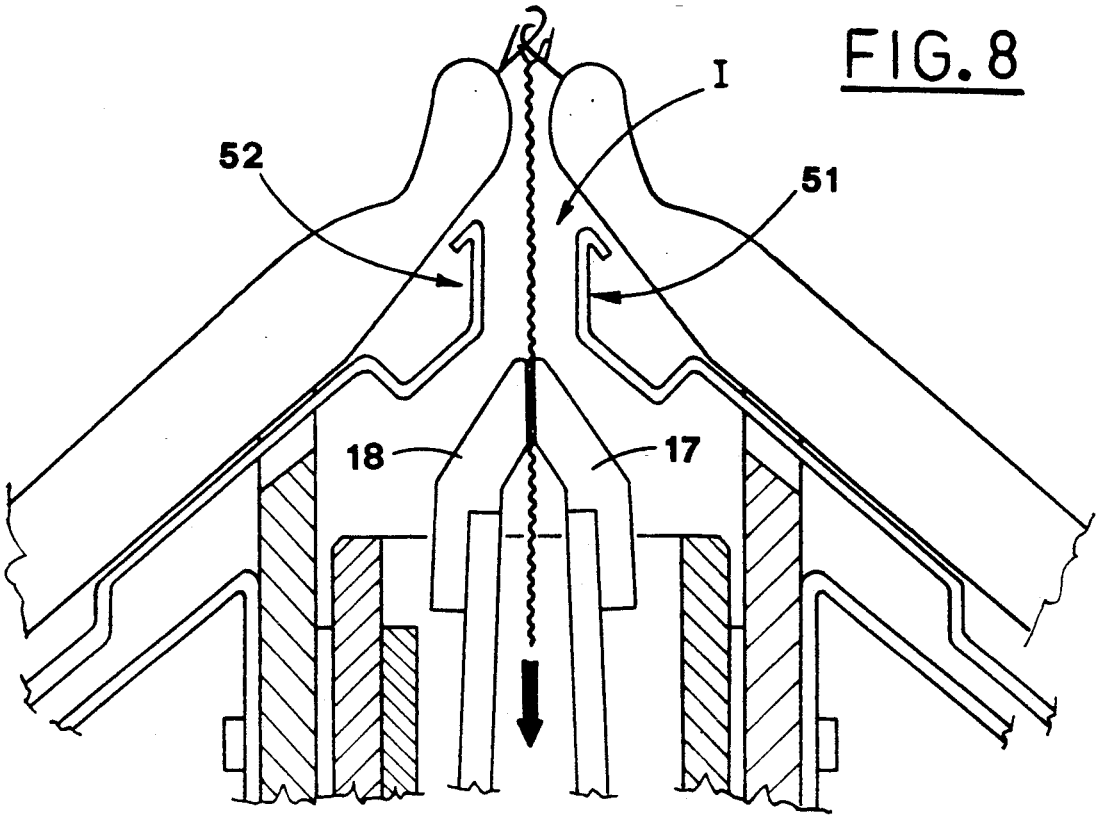
FIGS. 8 and 9 illustrate, on an enlarged scale, the opening and closing positions of the gripper parts.
Figure 9:
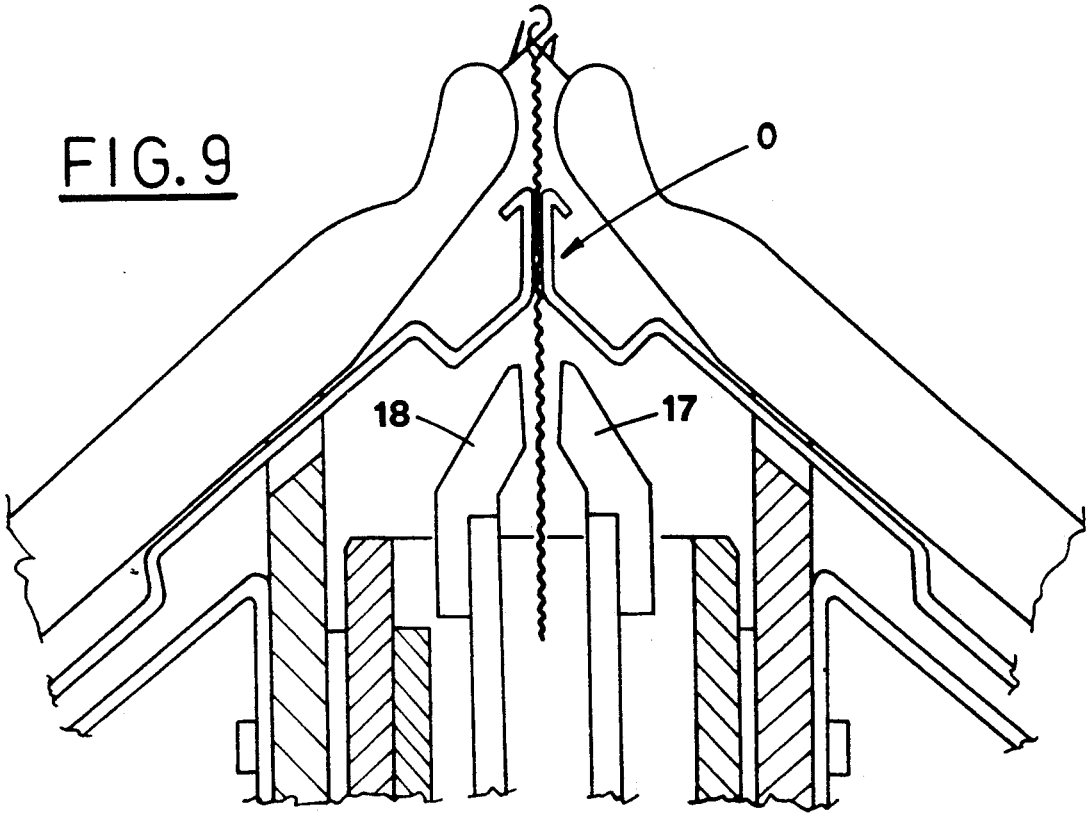

When the fabric has been stretched, if necessary the command is given for the closing of the grippers 50 that are open during the stretching stage (FIG. 8). The closing of the grippers 50 is commanded as already described, i.e. by energizing by energizing the electromagnets 71.

The grippers 50 hold fabric 3 taut during the opening of the holding parts 19 and the subsequent rising of the slides 39. A further rotation of the cam shaft 32, that frees the levers 31 (whose return to the rest position (FIG. 1) is speeded up by the action of the associated springs 38), and the intermittent rotation in reverse direction of the pinions 41, restores the device to the condition initially described for another stretching phase.

To summarize therefore the device in question involves the creation of a sequence of successive stages of lifting of the holding parts 19, closing of the said holding parts 19 (actuated in phase with the opening of the gripper parts 50) and consequent blocking of the fabric 3, descent of the holding parts 19 for the stretching of the fabric, opening of the same holding parts actuated in phase with the closing of the said gripper parts 50.

The descent of the holding parts may be achieved in a differential manner. These parts are activated with the carriage, that slides along the needle beds, inverts its stroke (i.e. at the end of the needle beds); in this situation the holding parts descend by a preset amount that is a function of the type of fabric as well as the type of knitting stitches with which the latter is created.

During the successive carriage stroke, the parts are further lowered according to the type of fabric, and the knitting stitches, as well as the number of rows that are formed with each carriage stroke; the number of these rows, as is known, is equal to the operative units provided on the carriage.

In phase with the new carriage stroke, there is opening of the holding parts 19, actuated in phase with the closing of the gripper parts 50, the rising of said parts to their maximum upper position and finally the closing of the said holding parts in phase with the opening of the gripper parts 50.

Therefore the device described makes it possible to obtain the uniform stretching of all the adjacent parts of the fabric, even in the presence of areas of different lengths of the same fabric.

Figure 10:
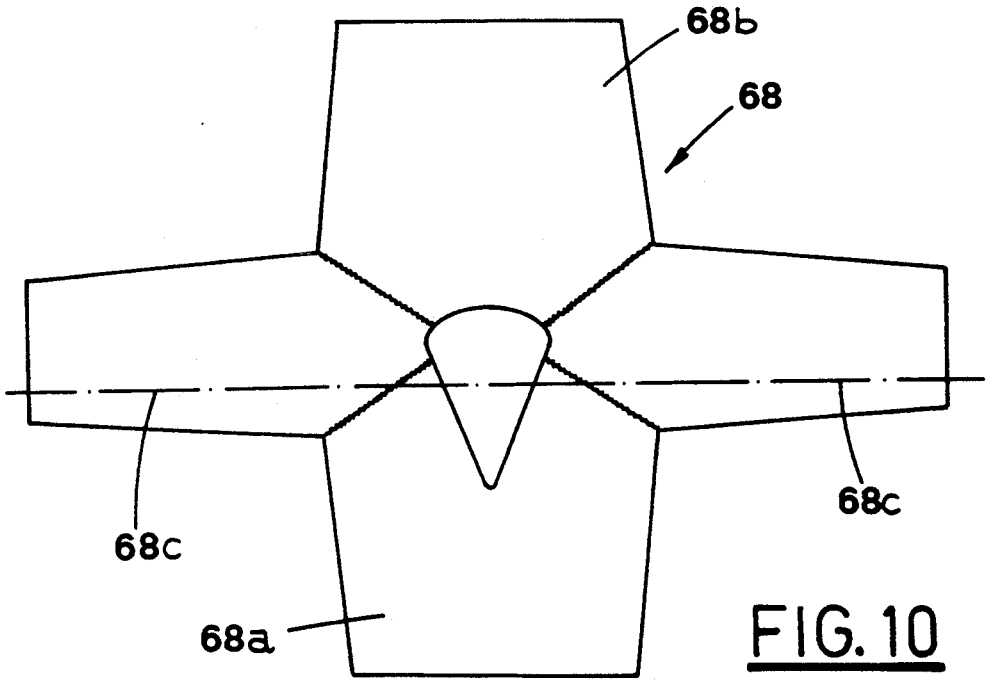
FIG. 10 illustrates a view of a knitting fabric element to be stretched with the device.

FIG. 10 illustrates, as an example, a knitted fabric 68 indicating the front 68*a* and rear 68*b* parts, as well as the side parts 68*c*. Unlike the traditional stretching devices, the alternate movement of the holding parts 19 is able to achieve vertical stretching along the entire length of this fabric, in particular even in correspondence with the side portions 68*c*.

The device is also simple to build, thus reducing considerably the costs of production and maintenance.

The inclusion of the gripper parts 50 optimizes the stretching, performed by the holding parts 19, for any type of fabric and/or knitting of the latter, regardless of the knitting pattern produced.

The applicant has observed that for some types of fabric and/or jersey, the use of the aforementioned gripper parts is not necessary; in these situations it is sufficient to avoid the energizing of the electromagnets, which is achieved, in a simple manner, by adjusting the program controlling the machine.

It can also be stressed that with the electromagnets de-energized, the gripper parts 50 remain in their inoperative position I (i.e. open) which facilitates any operations in the working area of the machine involved with the gripper parts 19.

In this description the device, subject of this invention, has been proposed associated with a flat-bed machine, for example for knit-wear.

This device can be usefully adopted with a circular type knitting machine, or with any kind of machine that produces fabric of whatever kind.

Everything that is described above is intended as a mere illustration and not limiting in any way (e.g. even the jaws 17 may be made to oscillate in phase with the corresponding jaws 18), therefore any production variations will be intended as part of the protected rights covered by this technical solution as described above and in the claims below.

What is claimed is:

1. A device for applying vertical tension to a knitted fabric in an automatic flat-bed knitting machine, the machine including first and second flat longitudinal needle beds supported by a machine frame, the knitted fabric descending below the needle beds, said device comprising:

a series of fixed jaws, equally spaced and fixed to an oscillating corner piece, said corner piece being joined to a first support part located under one of the needle beds, said corner piece and said first support part being parallel to said needle bed;

a series of oscillating jaws joined to a second support part and located under the other needle bed, said second support part being parallel to said first support part, said oscillating jaws being equally spaced so that each oscillating jaw faces a respective fixed jaw;

sliding means supported by said first and second support parts, said sliding means designed to vertically slide in an alternating motion between a raised position, where said fabric is held by said oscillating and fixed jaws, and a lowered position, where the fabric is released;

a plurality of cams in contact with said sliding means for causing a rotation of said corner piece and said oscillating jaws so that when said sliding means are in the raised position, the oscillating jaw and respective fixed jaw are brought together in a phase relation coordinated with the formation of the rows of fabric.

2. The device of claim 13 wherein each of said oscillating jaws if fastened to a comb, said comb being pivotally attached to said second support part, by a lever, hinged to said comb and biased, by a spring, held by said second support part, said levers being driven by said cams.

3. The device of claim 14 wherein said springs are positioned in a seat made in said levers, each spring being held by a nut engaging a knob resting on said comb, wherein said turning said nut adjust the biasing of the spring to adjust the tension of said jaws on the fabric.

4. The device of claim 13 wherein said sliding means are positioned at ends of the needle beds, said sliding means comprising a rack which engages a pinion revolving with an alternating motion on a support attached to the machine frame.

5. The device of claim 13 wherein said first and second support parts comprise angular elements, said angular elements being connected to each other and mounted on respective cross-members so that said angular elements are capable of sliding vertically, anti-friction material pads being located between each of said angular elements and said cross-members.

6. The device of claim 1 wherein said fixed and oscillating jaws comprise a body fixed to said support parts, a ledge protruding from each said body, said ledge sloping upwards and having a knurled vertical holding surface.

7. The device of claim 1 wherein said corner piece is oscillated by a cam in a first direction and biased by a spring positioned between said corner piece and said first support part, in a direction opposite the first direction.

8. The device of claim 1 wherein said combs and said corner piece are located at the same height.

9. The device of claim 1 which further comprises a series of grippers located in intermediate positions with respect to said fixed and oscillating jaws, said grippers being regularly spaced out along the lower surface of said needle beds and respectively comprising first and second flexible arms that face one another, said first and second arms being moveable between an inoperative position and an operative position in which said arms grip said fabric when it is released by the fixed and oscillating jaws.

10. The device of claim 9 wherein said first and second flexible arms each has a front head that faces the fabric, a central curved portion which slides within a slot within the respective cross-member of said machine frame and, a rod for connecting said curved portion with means for operating the grippers.

11. The device of claim 10 wherein said operating means comprise:

first and second levers each having a first branch hinged to a respective lower end of a rod and another end fixed to said support frame, each lever being horizontal and oriented longitudinally with respect to said needle beds, a second branch of each lever being nearly horizontal and having a free head, wherein said free heads of said first and second levers, are facing one another;

spring means for biasing said first and second levers to bias said first and second arms in said inoperative position; and activating means for directing said free heads facing one another in a direction opposing the bias of said spring means, to move said first and second arms into said operative position.

12. The device of claim 11 wherein said activating means comprise:

a vertical shank slidable within a stationary guide part, located within a vertical intermediate plane between said facing heads;

a cam shaft for axially moving said vertical shank, against the bias of said spring means, between a raised position and a lowered position; and an electromagnet, said electromagnet being fixed to said second branch of each said lever, said electromagnet having an armature located between said facing heads and said shank, wherein energizing and de-energizing said electromagnet causes said shank to move axially between the raised and lower positions to cause said levers to oscillate.

* * * * *